US011903478B1

(12) United States Patent
Yan

(10) Patent No.: US 11,903,478 B1
(45) Date of Patent: Feb. 20, 2024

(54) COSMETIC PRODUCT CONTAINER

(71) Applicant: ELC MANAGEMENT LLC, Melville, NY (US)

(72) Inventor: Jian Yan, Kirkland (CA)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 17/958,740

(22) Filed: Oct. 3, 2022

(51) Int. Cl.
*A45D 40/26* (2006.01)
*A45D 34/04* (2006.01)

(52) U.S. Cl.
CPC ..... *A45D 40/267* (2013.01); *A45D 34/046* (2013.01)

(58) Field of Classification Search
CPC .. A45D 34/045; A45D 40/265; A45D 34/047; A45D 40/268; A45D 34/046; A45D 40/267; A45D 34/042; A45D 40/262
USPC ..... 401/121, 122, 126–130
See application file for complete search history.

(56) References Cited

U.S. PATENT DOCUMENTS 6,045,280 A * 4/2000 Nadel ..... B29C 66/81431 401/122
8,403,580 B2 * 3/2013 De Laforcade ..... A45D 40/267 401/122
11,129,464 B2 * 9/2021 Berhault ..... A45D 40/267
2010/0166488 A1 * 7/2010 Bouix ..... A45D 40/0087 401/122

* cited by examiner

*Primary Examiner* — David J Walczak
(74) *Attorney, Agent, or Firm* — MARSHALL, GERSTEIN & BORUN LLP

(57) ABSTRACT

Systems and approaches for manufacturing containers for cosmetic substances include providing a container body having a first end and a second end and defining a container cavity that receives a cosmetic substance, and, during a two-shot molding process, forming 1) a container neck having a first end, a second end, and a neck wall and defining a neck cavity; and 2) a wiper integrally formed with at least a portion of the neck wall. The wiper includes a protrusion extending into the neck cavity. The container neck is operably coupled with the first end of the container body.

14 Claims, 8 Drawing Sheets

COSMETIC PRODUCT CONTAINER

FIELD OF THE DISCLOSURE

The present disclosure generally relates to cosmetic, hair care, body care, and/or skincare products and, more particularly, to containers for such products.

BACKGROUND

Cosmetic, hair care, body care, and/or skincare products may be provided in a number of different containers, and may be applied using a number of varying approaches. As an example, a mascara product may include a first portion having a reservoir for containing the product, and a second portion having a removable wand and/or brush to apply the product to the user, among other alternatives. Oftentimes, such products include wiping mechanisms to remove excess cosmetic product from the wand and/or brush prior to use. These wipers may be disposed within or otherwise coupled with a neck region of the first portion of the product. In examples where the wipers are coupled with the neck region, it may be difficult to properly retain the wiper within this region due to the required frictional engagement between the wand and/or brush and the wiper to remove excess product. In these examples, the frictional force between the wiper and the wand and/or brush may be greater than the retention force between the wiper and the neck region, which may result in inadvertent removal of the wiper during attempts to remove the wand and/or brush. Further, due to the arrangement of the wiper and the neck region of the product, the wand and/or brush may have minimal useable space to pass through, and as such, removal and use of such products may be difficult. Further, such arrangement of components may result in weakened regions along the first portion of the product, and may result in undesirable storage behavior.

In some examples, the wiping mechanisms may include multiple discrete members that assist with moving excess product from the wand and/or brush. Such arrangements may present problems relating to inadequate control of product removal, and may require highly precise control of the applicator surface/wiper interfaces in order to control the desired product dosage.

Accordingly, there is a need for improved accessories having improved functionalities.

SUMMARY

Examples within the scope of the present disclosure are directed to systems and approaches for manufacturing containers for cosmetic substances. Such systems and approaches include providing a container body having a first end and a second end and defining a container cavity that receives a cosmetic substance, and, during a two-shot molding process, forming 1) a container neck having a first end, a second end, and a neck wall and defining a neck cavity; and 2) a wiper integrally formed with at least a portion of the neck wall. The wiper includes a protrusion extending into the neck cavity. The container neck is operably coupled with the first end of the container body.

In an approach, the step of operably coupling the container neck with the first end of the container body includes at least one of ultrasonically welding, mechanically coupling, or applying an adhesive to secure the container neck with the first end of the container body. In these and other examples, the step of forming the container neck may include forming a base at the first end thereof that is insertable into the first end of the container body. Further, in some approaches, the step of forming the wiper may include forming a seal portion that forms a seal between the container body and the base of the container neck.

In these and other approaches, the container neck may be formed from a first material and the wiper may be formed from a second material. The first material may have a hardness value that is greater than the second material.

In some examples, the container neck is formed from at least one of acrylonitrile butadiene styrene (ABS), Polyethylene terephthalate (PET), a glycol-modified copolyester, polycarbonate (PC), or polypropelene (PP). In these and other forms, the wiper is formed from at least one of a thermoplastic elastomer (TPE), a plasticizer-free thermoplastic polyester elastomer, or silicone rubber.

In some approaches, the two-shot molding process comprises an overmolding process. In some forms, the approach may further include the step of forming the container body via an injection process or a blow molding process.

In accordance with a second aspect, a container for a cosmetic substance includes a container body, a container neck, and a wiper. The container body includes a first end and a second end and defines a container cavity that receives a cosmetic substance. The container neck has a first end, a second end, and a neck wall and defining a neck cavity. The first end of the container neck is operably coupled with the first end of the container body. The wiper is integrally formed with at least a portion of the neck wall. The wiper includes at least one protrusion extending into the neck cavity of the container neck.

BRIEF DESCRIPTION OF THE DRAWINGS

The above needs are at least partially met through provision of one, more than one, or any combination of the systems and approaches for manufacturing containers for cosmetic substances described in the following detailed description, particularly when studied in conjunction with the drawings, wherein.

Figure 1:
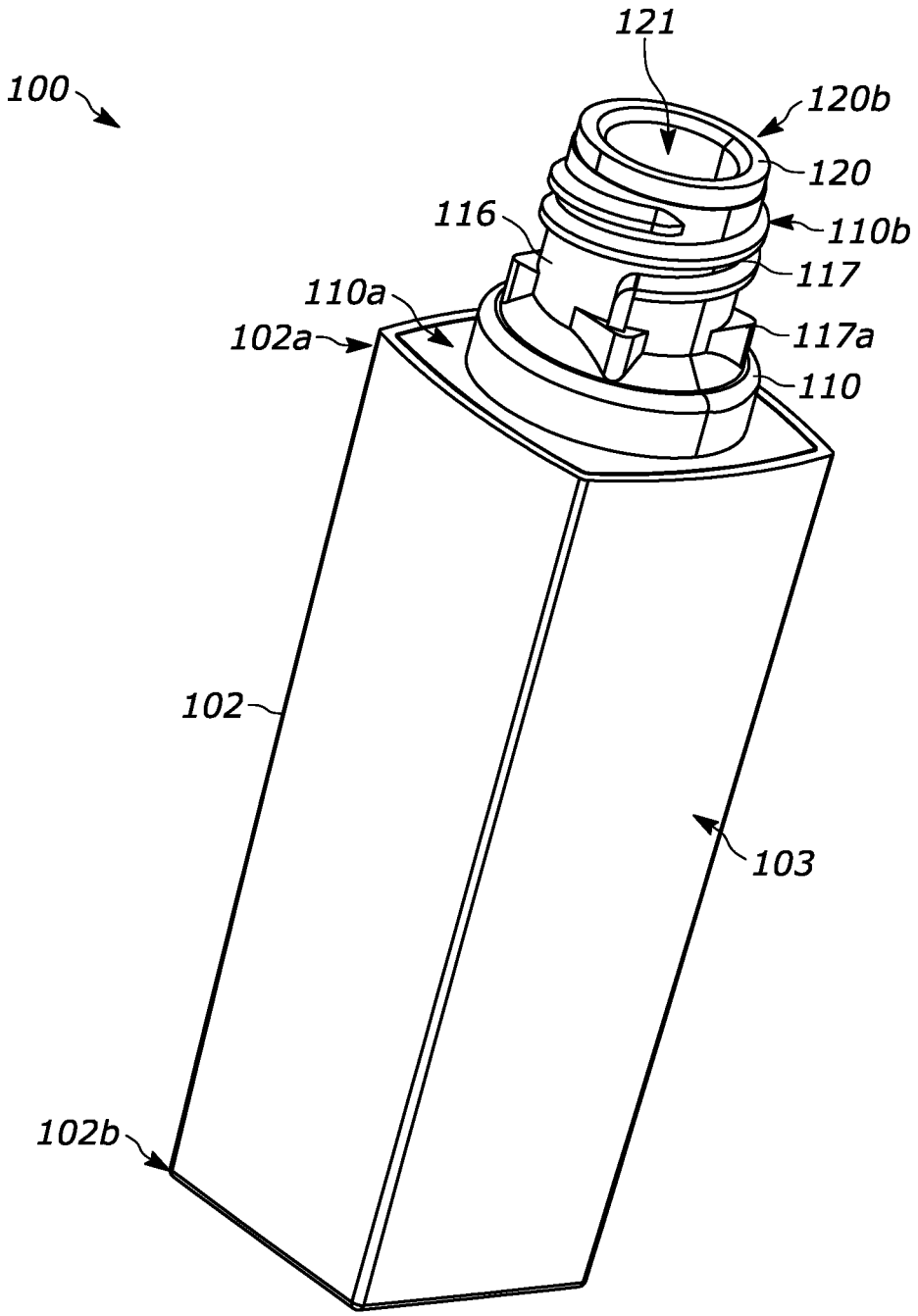
FIG. 1 illustrates a perspective view of an example container for containing a cosmetic substance in accordance with various examples.
Figure 2:
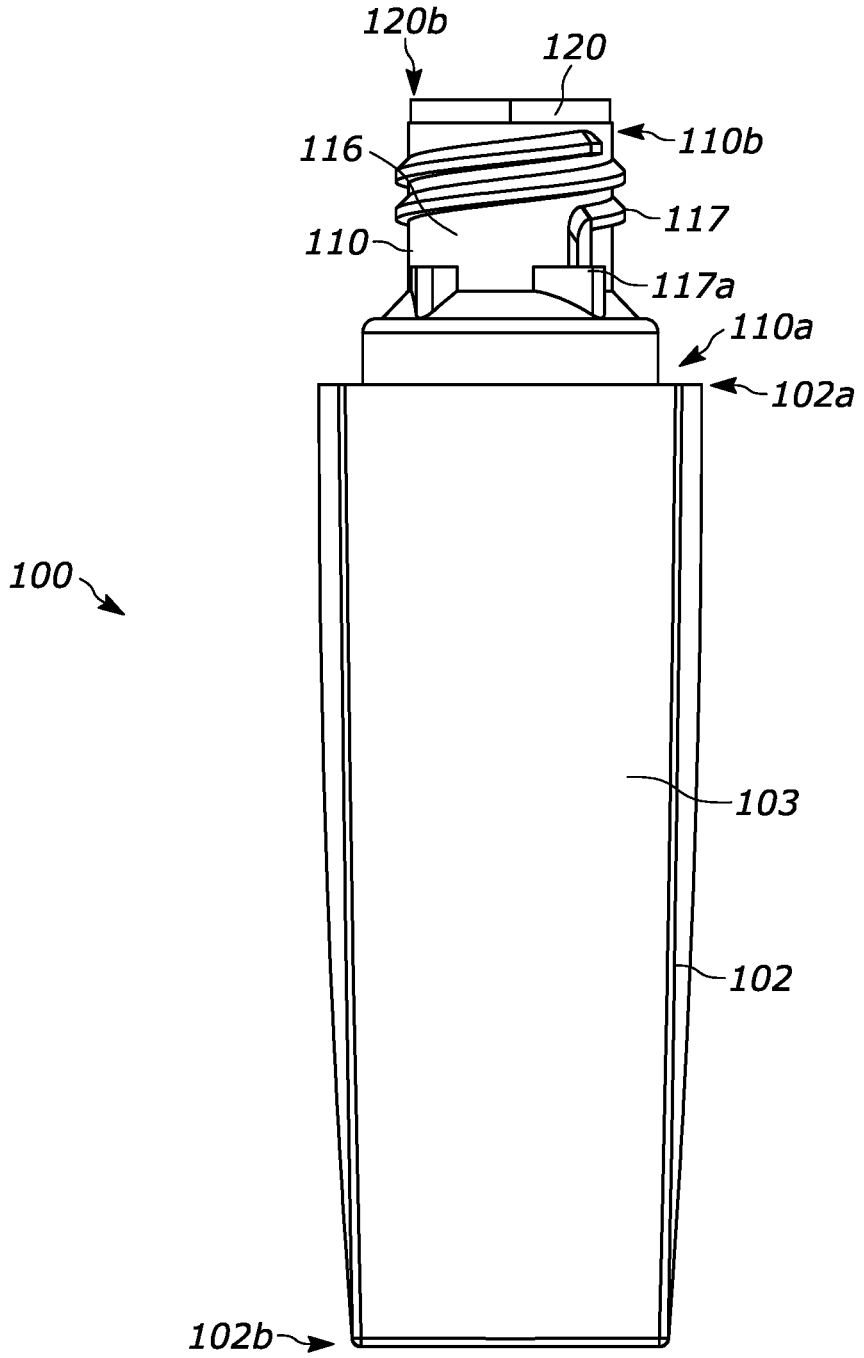
FIG. 2 illustrates a side elevation view of the example container of FIG. 1 in accordance with various examples.
Figure 3:
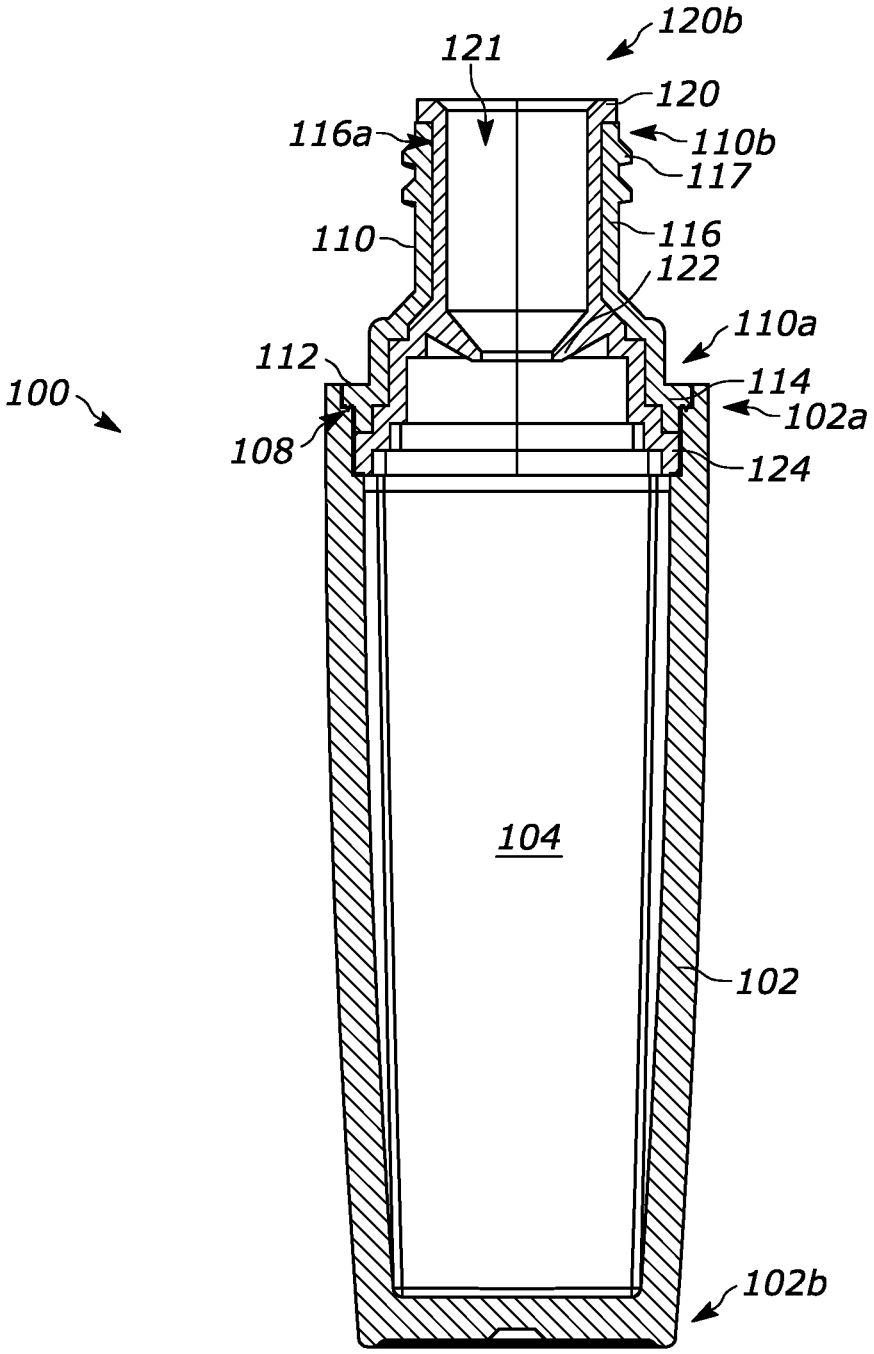
FIG. 3 illustrates a front elevation cross-sectional view of the example container of FIGS. 1 & 2 in accordance with various examples.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, a container for containing a cosmetic substance is provided that includes a formed neck region incorporating a wiper mechanism therewith. In some examples, the neck region is formed via a multi or two-shot molding process whereby the wiper mechanism is first molded or formed, and subsequently, the remaining neck portion is folded or formed onto and/or around the wiper mechanism. Such formation advantageously provides for more space inside the neck cavity, thereby resulting in improved performance of the wiper mechanism.

Turning to the Figures, a container 100 includes a vial or container body 102, a container neck 110, and a wiper 120. The container body 102 includes a first end 102*a*, a second end 102*b*, and a container sidewall 103 defining a container cavity 104 that retains a cosmetic substance (not illustrated). The container body 102 may be formed from any number of suitable materials such as, for example, glass, polymeric materials, metallic materials, and the like.

In some examples, the cosmetic substance may be in the form of a mascara product, an eyeliner product, or a lip gloss product that is applied using an applicator. It is to be appreciated that in some of these examples, the cosmetic substance may be any type of cosmetic, hair care, body care, and/or skincare product that may be applied to a user. Other examples are possible. In some of these examples, the cosmetic substance may include strong or otherwise aggressive chemicals and/or ingredients such as, for example, volatiles such as isododecane.

Figure 5:
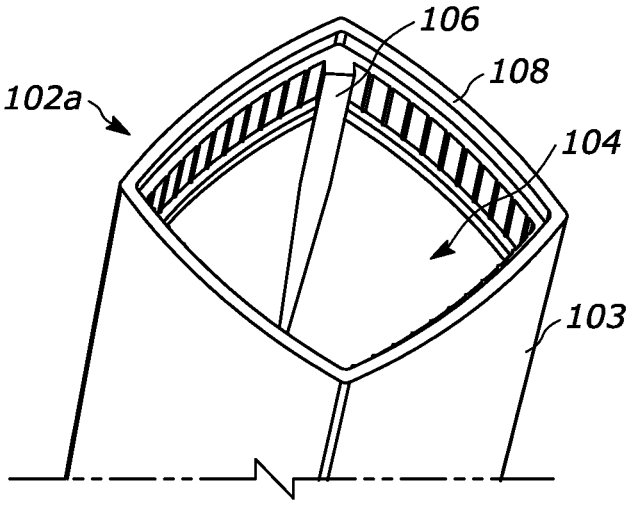
FIG. 5 illustrates an upper perspective view of an example container body for use with the example container of FIGS. 1-4 in accordance with various examples.
Figure 6:
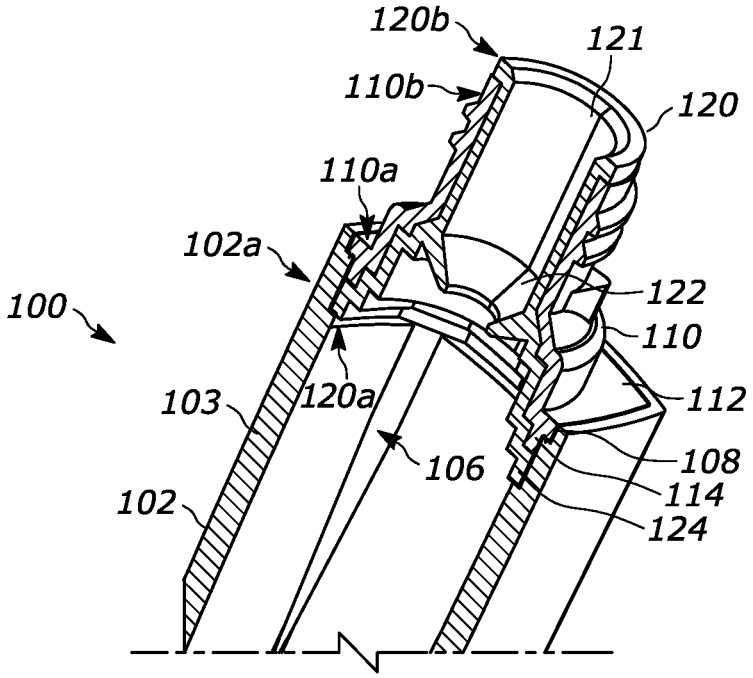
FIG. 6 illustrates an upper perspective cross-sectional view of the example container of FIGS. 1-5 in accordance with various examples.

The container body 102 further includes a key portion 106 (FIG. 5) formed on the sidewall 103 and at least one ledge 108 formed at the first end 102*a* thereof. In the illustrated example, the key portion 106 is in the form of an elongated protrusion or notch along the sidewall 103. Other examples of suitable structures are possible.

The container neck 110 includes a first end 110*a* and a second end 110*b*. The first end 110*a* includes a base 112 having a platform 112*a*. In some examples, the platform 112*a* engages the ledge 108 of the container body 102 to operably couple the container neck 110 with the container body 102. In some examples, the base 112 may additionally include an extension 114 that may frictionally engage or snap with a portion of the container sidewall 103 to form a seal with the container body 102.

Figure 7:
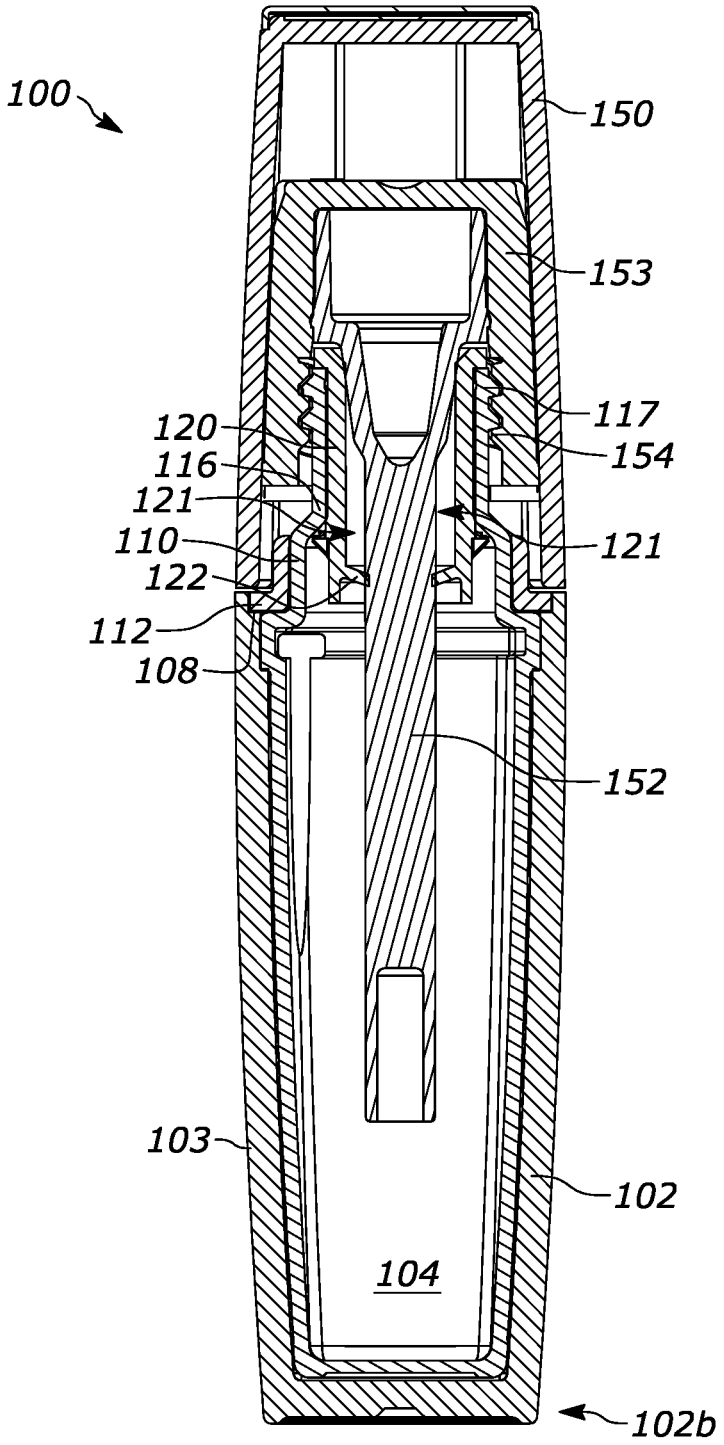
FIG. 7 illustrates a front elevation cross-sectional view of the example container of FIGS. 1-6 coupled with an example handle and applicator in accordance with various examples.
Figure 8:
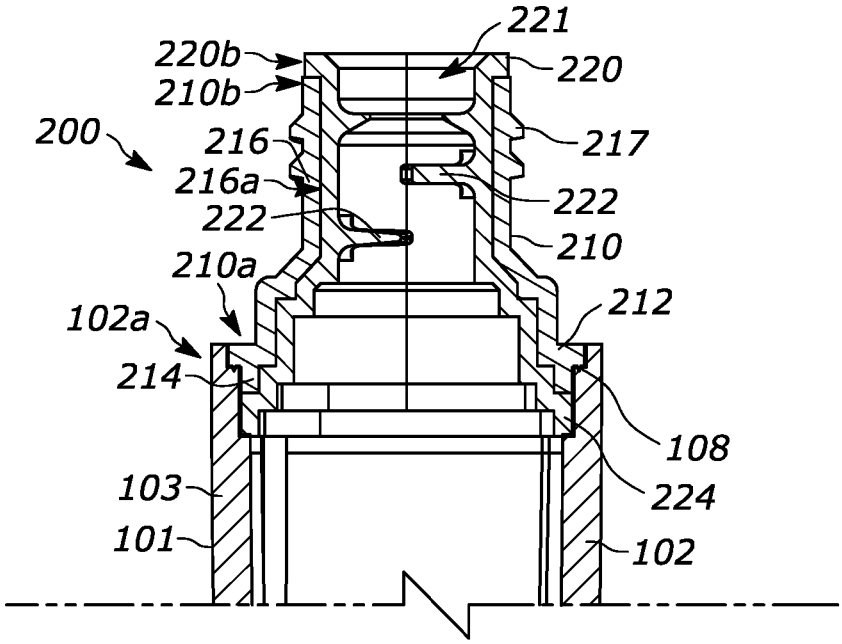
FIG. 8 illustrates a front elevation cross-sectional view of an example container having an alternative container neck and wiper in accordance with various examples.
Figure 9:
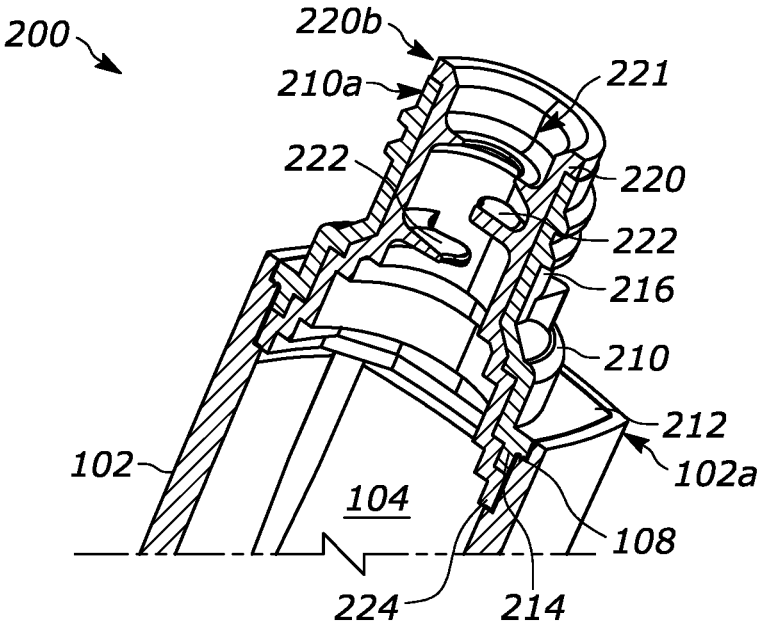
FIG. 9 illustrates an upper perspective cross-sectional view of the example container of FIG. 8 in accordance with various examples.

The second end 110*b* includes a neck wall 116 that defines a neck cavity 116*a* therein. A coupling portion 117 may be disposed on an outer periphery of the neck wall 116 to operably couple a cap or handle 150 (FIG. 7) that includes wand 152 (FIG. 7) having a brush or other applicator (not illustrated) to apply the cosmetic substance to a user. In some examples, the coupling portion 117 may be in the form of a threaded member having any number of desired stopping or anti-rotation members 117*a* positioned at a terminal end thereof. Such members 117 may engage corresponding threaded members 154 disposed or otherwise formed on the cap 150. In the illustrated example, the cap 150 includes an inner cap 153 that carries the threaded members 154 and additionally retains the wand 152 via any number of suitable approaches. Other examples are possible.

The container neck 110 may be constructed or formed from any number of suitable materials such as, for example, acrylonitrile butadiene styrene (ABS), Polyethylene terephthalate (PET),a glycol-modified copolyester (PCTA, PCTG), polycarbonate (PC), or polypropelene (PP). Other examples are possible.

The wiper 120 is used to remove excess quantity of cosmetic substance from the product applicator or brush and includes a first end 120*a*, a second end 120*b*, and defines a wiper cavity 121. The wiper 120 further includes at least one protrusion 122 that extends inwardly into the wiper cavity 121. In this example, the protrusion 122 is in the form of a downwardly-angled ring or flap that encircles a portion of the periphery of the wiper cavity 121. The wiper 120 is generally disposed within the neck cavity 116*a*. In the illustrated example of FIGS. 1-6, the wiper 120 extends a distance beyond the second end 110*b* of the container neck 110 to a distance beyond the first end 110*a* thereof. Other arrangements are possible.

The wiper 120 may be constructed or formed from any number of suitable materials such as, for example, a thermoplastic elastomer (TPE), a plasticizer-free thermoplastic polyester elastomer, or silicone rubber. Other examples are possible. Generally speaking, the wiper 120 is constructed from a relatively softer material than the container neck 110 (i.e., the container neck 110 is formed from a material having a higher hardness value than the material used to form the wiper 120), and as such, the container neck 110 provides stability during removal and insertion of the wand 152 and brush or applicator from the container body 102, while the protrusion or protrusions 122 flex to remove excess cosmetic substance from the brush. More specifically, the protrusions or protrusions 122 are dimensioned such that they extend into the wiper cavity 121 a distance sufficient to contact a surface of the brush or applicator, thereby causing interference between the components that may cause excess cosmetic substance carried by the brush to be removed therefrom.

The container neck 110 and the wiper 120 may be formed via a two-shot molding or forming process. For example, the container neck 110 and the wiper 120 may be formed via an overmolding or other two-step process such as bi-injection or any other suitable injection or blow molding process. In some examples, the wiper 120 is molded or otherwise formed using an overmolding process, whereupon a portion of the mold is released and the mold is rotated or turned (e.g., approximately 180°) such that a second nozzle is positioned adjacent to the mold cavity. The container neck 110 is then injected, molded, or otherwise formed on the wiper 120, whereupon a single, integrally formed member having the container neck 110 and the wiper 120 is produced.

Figure 4:
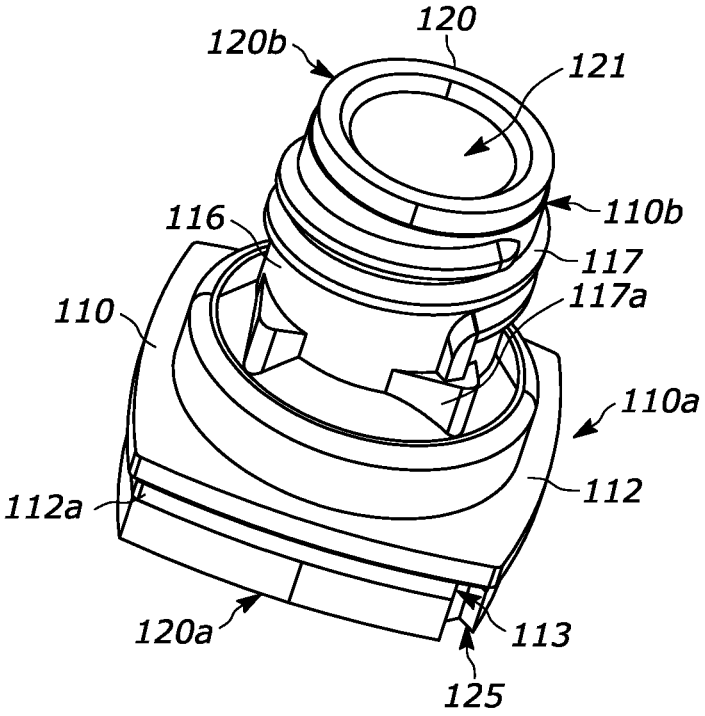
FIG. 4 illustrates an upper perspective view of an example container neck and wiper for use with the example container of FIGS. 1-3 in accordance with various examples.

The formed container neck 110 and wiper 120 are then coupled and secured with the first end 102*a* of the container body 102 via any number of suitable approaches such as, for example, ultrasonic welding, adhesives, friction-fit or snapping connections, or any other suitable approach. More specifically, the base 112 of the container neck 110 may be positioned within the opening at the first end 102*a* of the container body 102 and aligned therewith such that the key portion 106 of the container body 102 is at least partially disposed or otherwise inserted within the slotted portion 113 of the container neck 110 and a slotted portion 125 of the wiper 120 (FIG. 4). When the base 112 of the container neck 110 abuts the ledge 108 of the container body 102, the extension 114 of the container neck 110 may abut and compress the seal portion 124 of the wiper 120. Upon coupling the container neck 110 with the container body 102, the seal portion 124 engages a portion of the container sidewall 103 to generate an additional sealing force to retain the cosmetic substance within the container cavity 104.

Because the wiper 120 and container neck 110 are formed via a two-shot molding or forming process, the container neck wall 116 may have a reduced thickness as compared with conventional designs and as such, the neck cavity 116*a* and the wiper cavity 121 may be larger than conventional designs. Such an increased neck and wiper cavity 116*a*, 121 may allow for product applicators or brushes having larger and varied configurations to be used with the container body 102. Further, the wiper 120 and container neck 110 provide for better and increased retention force, and reduce the risk of the wiper 120 being unexpectedly removed from the container neck 110 during removal of the wand and/or brush 152.

Notably, the materials used to form the container neck 110 and the wiper 120 are compatible with each other (and additionally are compatible with the container body 102), and as such, the molding or forming process allows for the consistent production of satisfactory parts.

It is also to be appreciated that the wiper 120 may be provided in any number of varying shapes and/or configurations. As non-limiting alternative examples, FIGS. 8-11 illustrate alternative wipers 220, 320 that may be incorporated into the cosmetic product 100. These wipers 220, 320 include similar features as the wiper 120, and as such, are provided with reference numerals having identical two-digit suffixes. For the sake of brevity, such components will not be described in further detail. In the example wipers 220, 320, the two-shot or overmolding process is used to form additional components that may improve operation of the container 100.

In the example wipers 220, 320 illustrated in FIGS. 8-11, a number of protrusions 222, 322 are provided in the form of discrete fingers positioned at varying heights between the first and second ends thereof. These finger-like protrusions may be separately designed to control the dosage while allowing the wand and/or brush surface to be independently and with greater flexibility. More specifically, in these examples, because the protrusions 222, 322 extend beyond the central region of the cavities 221, 321, the top of the brush and/or applicator may additionally be wiped. Such wiping cannot be achieved with a protrusion in the form of a ring due to its inherent geometry.

Figure 10:
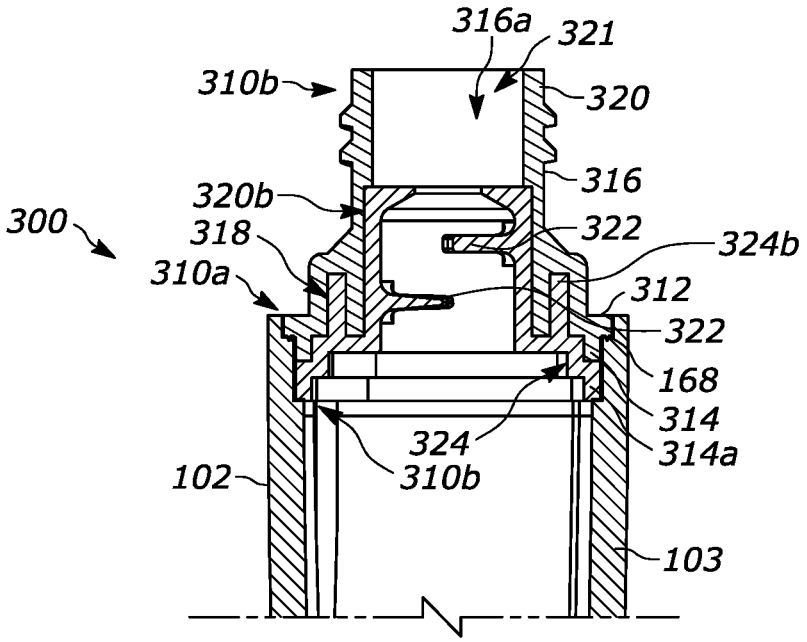
FIG. 10 illustrates a front elevation cross-sectional view of an example container having a second alternative container neck and wiper in accordance with various examples.
Figure 11:
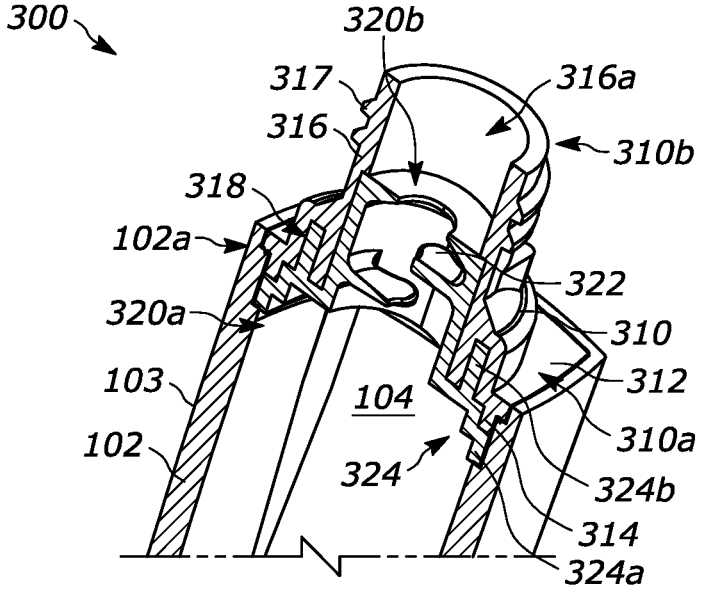
FIG. 11 illustrates an upper perspective cross-sectional view of the example container of FIG. 10 in accordance with various examples.

Further, in the example wiper 320 illustrated in FIGS. 10 and 11, the second end 320*b* of the wiper 320 is positioned or disposed at a relatively lower length along the container neck 310, and as such, does not extend to the second end 310*b* of the container neck 310. As such, the wiper 320 may appear to be "hidden" to a user, thereby enhancing a user's experience. This wiper 320 includes a protrusion in the form of a ring to provide for controlling the overall dosage of cosmetic product. Further still, the wiper 320 includes a seal portion 324 having a stepped portion 324*a* that engages the extension 314 of the container neck 310 in a similar manner as previously described with respect to FIGS. 1-6, but additionally includes an annular seal wall 324*b* that engages a neck channel 318 to generate an additional seal between the container body 102, the container neck 310, and the wiper 320. Such an arrangement provides for additional air-tight configuration.

Further, it is appreciated that while each of the container neck 110 and the wiper 120 include a slotted portion 113, 125 that receives the key portion 106 of the container body 102 for the purposes of alignment, in some examples, only one of these components may include a slotted portion depending on their relative desired geometries.

So configured, the system allows a consumer to remove the brush or applicator in a single swipe or motion. The integrated wiper provides for more usable space within the neck cavity, which may allow for the use of brushes having larger dimensions to be used. Further, because the wiper is molded using relatively soft materials, the molding process can generate aggressive protrusion patterns such as undercuts or similar geometries. The provided protrusions reduce undesirable clumps that may otherwise impact performance.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive, and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separately claimed subject matter.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A method of manufacturing a container for a cosmetic substance, the method comprising:

providing a container body having a first end and a second end and defining a container cavity adapted to receive a cosmetic substance;

during a two-shot molding process, forming 1) a container neck having a first end, a second end, and a neck wall and defining a neck cavity, the first end including a base adapted to be insertable into the first end of the container body; and 2) a wiper integrally formed with at least a portion of the neck wall, the wiper including a protrusion extending into the neck cavity and a seal portion adapted to form a seal between the container body and the base of the container neck; and operably coupling the container neck with the first end of the container body.

2. The method of claim 1, wherein the step of operably coupling the container neck with the first end of the container body includes at least one of ultrasonically welding, mechanically coupling, or applying an adhesive to secure the container neck with the first end of the container body.

3. The method of claim 1, wherein the container neck is formed from a first material and the wiper is formed from a second material, the first material having a hardness value that is greater than the second material.

4. The method of claim 1, wherein the container neck is formed from at least one of acrylonitrile butadiene styrene (ABS), Polyethylene terephthalate (PET), a glycol-modified copolyester, polycarbonate (PC), or polypropelene (PP).

5. The method of claim 1, wherein the wiper is formed from at least one of a thermoplastic elastomer (TPE), a plasticizer-free thermoplastic polyester elastomer, or silicone rubber.

6. The method of claim 1, wherein the two-shot molding process comprises an overmolding process.

7. The method of claim 1, further comprising the step of forming the container body via an injection process or a blow molding process.

8. The method of claim 1, wherein the step of forming a wiper comprises forming a plurality of protrusions disposed at different heights within the neck cavity.

9. A container for a cosmetic substance, the container comprising:

a container body having a first end and a second end and defining a container cavity adapted to receive a cosmetic substance;

a container neck having a first end, a second end, a neck wall and defining a neck cavity, and a base adapted to be insertable into the first end of the container body, the first end of the container neck being operably coupled with the first end of the container body; and a wiper being integrally formed with at least a portion of the neck wall, the wiper including at least one protrusion extending into the neck cavity of the container neck and a seal portion adapted to form a seal between the container body and the base of the container neck.

10. The container of claim 9, wherein the container body and the container neck are operably coupled via at least one of ultrasonic welding, a mechanical coupling, or an adhesive.

11. The container of claim 9, wherein the container neck is formed from a first material and the wiper is formed from a second material, the first material having a hardness value that is greater than the second material.

12. The container of claim 9, wherein the container neck is formed from at least one of acrylonitrile butadiene styrene (ABS), Polyethylene terephthalate (PET),a glycol-modified copolyester, polycarbonate (PC), or polypropelene (PP).

13. The container of claim 9, wherein the wiper is formed from at least one of a thermoplastic elastomer (TPE), a plasticizer-free thermoplastic polyester elastomer, or silicone rubber.

14. The container of claim 9, wherein the at least one protrusion includes a plurality of protrusions arranged at varying heights between the first end and the second end of the container neck.

* * * * *